US006496235B1

(12) United States Patent
Driscoll et al.

(10) Patent No.: US 6,496,235 B1
(45) Date of Patent: Dec. 17, 2002

(54) LCD SLIDER

(76) Inventors: Robert W. Driscoll, C/O 42 Warren Ter., Longmeadow, MA (US) 01106; Edward Wood, C/O 42 Warren Ter., Longmeadow, MA (US) 01106; Peter Kristoffy, C/O 42 Warren Ter., Longmeadow, MA (US) 01106

( * ) Notice: Subject to any disclaimer, the term of this patent is extended or adjusted under 35 U.S.C. 154(b) by 256 days.

(21) Appl. No.: 09/663,428

(22) Filed: Sep. 16, 2000

Related U.S. Application Data

(60) Provisional application No. 60/154,544, filed on Sep. 17, 1999.

(51) Int. Cl.[7] ..... G02F 1/1335
(52) U.S. Cl. ..... 349/58
(58) Field of Search ..... 349/58

(56) References Cited

U.S. PATENT DOCUMENTS 6,055,032 A * 4/2000 Osterhout et al. ..... 349/84

* cited by examiner

*Primary Examiner*—James Dudek
(74) *Attorney, Agent, or Firm*—Deborah A. Basile

(57) ABSTRACT

The invention is an improvement to LCD game playing devices whereby a colored reflective surface is added that is larger than the LCD viewing area which allows the LCD to move over the background with intelligence. Thus, the LCD's normally static colored background will change. This change can be used to have a scrolling landscape or to move to new background graphics that reflect new game playing themes. The reflective surface as a whole remains static but as viewed through the moving LCD it will appear to be scrolling or changing. The LCD will light up to reveal different images most likely relative to the current background. The reflective surface can be printed in a circular path, a linear path, a two-dimensional surface, intersecting linear paths or a perimeter shape. The computer chip housed within the game playing device will know where the LCD is relative to the background. This knowledge and the physical movement of the LCD is used to enhance game play.

4 Claims, 2 Drawing Sheets

LCD SLIDER

This application claims the benefit of Provisional application Ser. No. 60/154,544, filed Sep. 17, 1999.

BACKGROUND OF THE INVENTION

1. Field of the Invention

The invention relates to the field of toys and games; specifically to liquid crystal display (LCD) game playing devices either as stand alone games or as a component or components in a game. The invention consists of an improvement to LCD game playing devices whereby a colored reflective surface is installed below the LCD apparatus which is larger than the LCD viewing area and which allows the LCD to move over a background with intelligence. The invention allows the LCD's normally static colored background to change. This change can be manifested in the form of but is not limited to a scrolling landscape or a set of graphics which would introduce a new theme to the game playing device. The reflective surface itself is static but as viewed through the LCD by a player during game play, the reflective surface will be scrolling or changing. The LCD will highlight and reveal different images or graphics on the background. The reflective surface can be printed so that the viewing area will follow a circular path, a linear path, intersecting linear paths, a two-dimensional surface or the perimeter of the housing. A micro controller within the game playing device (or similar state machine) will have knowledge of where the LCD is at any given time during play in reference to the printed background or game playing device housing. This knowledge is used to effect game play and product performance. The product will react in accordance to the current background via the LCD and/or audio feedback, to enhance game play. The method by which the LCD is moved over the printed surface can take many forms including but not limited to a framed housing containing the LCD which slides over the game surface along a predetermined path. The game playing device's housing will have an electronic circuit board and the LCD, which is semi-transparent in nature. The electronics will include a micro controller or simple state machine to monitor, switch and/or sensor inputs and control the LCD and audio transducer. The sensor inputs will provide the micro controller with the ability to keep track of the position of the LCD with respect to the reflector at any given time during game play. The sensor can consist of but is not limited to the following: an infrared emitter/detector pair or an electromechanical switch.

2. Information Disclosure Statement

Currently in the field of art, there are LCD game playing devices which have static backgrounds, where the LCD cannot be moved during game play. There may be LCD games where the background graphics can change in a linear fashion by scrolling the background material itself much like a camera moves film behind a shutter. But to date, there are no electronic LCD games which allow for a simple method of changing the background image behind the LCD by allowing the LCD, itself to be moved over the reflective background surface. Typically, in the current art the only color on the display of inexpensive LCD products is introduced through the use of a colored LCD reflector (the colored image is printed on a reflective insert). The images on the actual LCD (typically one color—black) can change as the product is handled, but the image printed on the reflector cannot change. There are many electronic hand held LCD games with colored reflectors. In some LCD games a colored background is placed behind the LCD to add color. The LCD is black and white, actually transparent. In these products the black and white image can change via the LCD but the colored image cannot change. There are LCD game systems which incorporate colored LCDs. These games allow for colored movement on the screen through the LCD itself. Notwithstanding the above, the current electronic hand held LCD games with colored reflectors have static backgrounds. The background image does not change in the current art. Also, current LCD game systems that have colored LCDs are too expensive for the stand-alone hand held LCD game market. Currently colored LCD games are based on cartridge systems which are higher priced. Colored LCDs do not provide the same resolution as can be obtained in the printed reflector artwork taught by this disclosure. The LCD products that have a mechanism for scrolling the background image behind a non-moving LCD are either (1) too expensive for the hand held LCD market (if it uses a motor to control the scrolling), or (2) too difficult to maneuver (if it does not incorporate a motor but is instead hand-cranked). None of the past solutions allow for the physical sliding or movement of the LCD over a game playing surface. The physical movement enhances game play by making the movement of the LCD part of the skill needed to play the game.

BRIEF SUMMARY OF THE INVENTION

During game play, the frame or housing of the game playing device is moved over a colored background or play surface. The LCD is transparent and has graphic segments (small individual pieces of artwork) that turn on or off under computer control. When the segments are on, they. are black; when they are off, they are transparent. If the framed LCD is allowed to move over a colored background, the colored image changes with respect to the LCD. The colors on the background will not change but the colored image behind the LCD will change or animate as viewed through the LCD. The computer will keep track of the frame's position so that it will know the current status of the colored background. The game through the LCD display or audio will react to the current background. This means that if the LCD is moved from one section of the play surface to another, the game play can change to reflect a new theme which might be presented by the background graphics or to react differently to new obstacles which might be illustrated on the background graphics. This enhances game play by either forcing a player to move the LCD to accomplish goals or by introducing new themes to the game player.

In the preferred embodiment there will only be one LCD apparatus. Its size will be dependent upon the application but may be for example 1.25 inches by 1.25 inches. The LCD must be smaller than the colored background surface because it will be slid over that surface. It will always be the same display physically but the display is active, i.e., segments are turned on and off by the computer; so the images on the LCD will constantly change. Also, there may be images on the LCD that only appear when the LCD is moved to certain parts of the playing surface. The novelty of the invention is that the background changes as the LCD is physically slid over the surface of the game playing device. Another novel feature is that the computer chip will know where the LCD is relative to the background so that the game can react to the background changes. Both of these features enhance game play and enhance game playing theme possibilities.

PREFERRED EMBODIMENT OF THE INVENTION

General Description:

The invention is based on the concept of creating an electronic game playing device with LCD displays where the LCD can be slid or moved by the player over a printed background surface.

Figure 1:
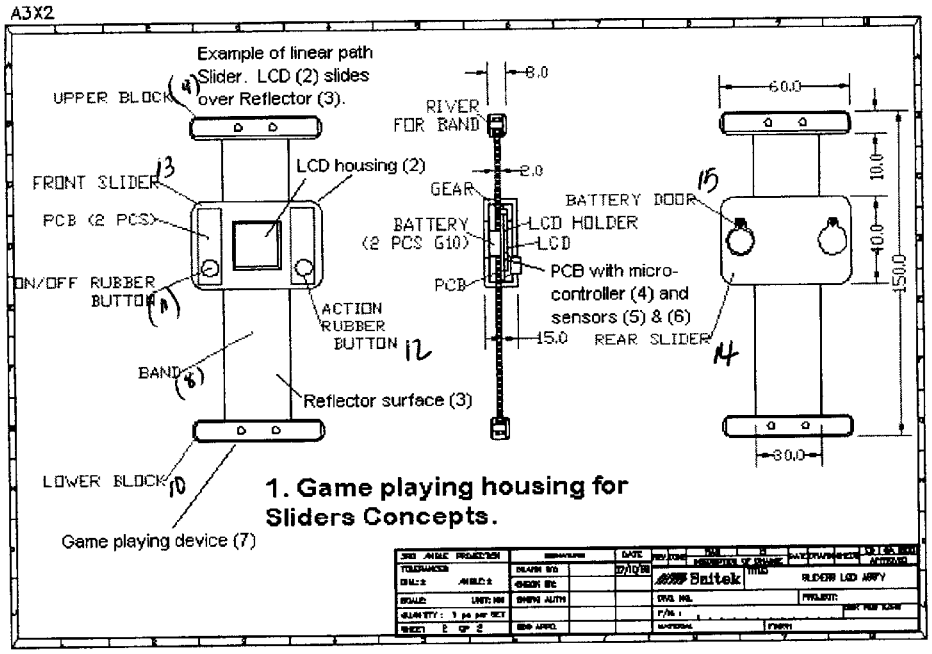
FIG. 1 shows a game housing according to an embodiment.

Referring to FIG. 1, the invention consists of a game-playing housing (1), for the LCD slider, which consists of a liquid crystal display (LCD) which is semi-transparent in nature (2), a reflector or reflective printed surface (3) installed below the LCD housing (2). An electronic circuit board consisting of microcontrollers (4) and sensors (5) and (6). The game playing housing (1) further comprises a band (8) on which the LCD housing (2) is installed. The game playing device (7) further comprises an upper block (9) and a lower block (10). The LCD housing (2) comprises an on/off rubber button (11) and an action rubber button (12). The LCD housing has a front slider (13) and a rear slider (14). The rear slider (14) has a battery door (15). The electronic circuit board (4) (5) (6) include a microcontroller or similar state machine to monitor the location of the LCD and a switch and or sensor inputs to control the LCD and audio transducer. The sensor inputs provide the microcontroller with the ability to know the location of the position of the LCD with respect to the reflective printed surface. The sensor may be comprised of, but is not limited to, the following: infrared emitter/detector pair and/or an electro-mechanical switch.

The game playing device (7) will utilize methods including but not limited to the following for movement of the LCD (2) over the printed reflector surface (3): (a) a linear path or intersecting linear path; (b) a circular path; (c) a two-dimensional surface; (d) along the perimeter of the housing, such as in the shape of a rectangle.

During game play of the preferred embodiment, a frame of the housing is moved over a colored background or playing surface by the player pushing the frame with the player's hand or using a knob to move the frame. The LCD is transparent and has small individual graphic designs or artwork which turn on or off under computer control. When the graphics or artwork are on, they are black; when they are off, they are transparent. By allowing the framed LCD to move over the colored background, the colored image can change. The colors on the background will not change but the color image behind the LCD will change or become animate. The computer housed within the game playing device will keep track of the frame's position so that it will know what the current status is of the colored background. Therefore, the game through the LCD display and/or sound will react to the current background. This means that if the LCD is moved from one section of the playing surface to another, game play can change to reflect a new theme presented by new background graphics or to react differently to new obstacles which are illustrated on the background graphics. To summarize and clarify, the invention consists of a game playing housing with an electronic circuit board. It is preferred embodiment a hand held plastic toy or game with an electronic module that includes an LCD. The housing will be designed such that the LCD can be maneuvered over the colored artwork on reflective material. The liquid crystal display is semi-transparent in nature. LCD's have artwork that can be turned on or off under the control of a microcontroller or similar state device. Whereever the artwork is not turned on, the LCD is transparent, and the artwork below the LCD is visible. A reflector or reflective surface is installed below the LCD on the bank. LCDs are typically positioned in front of reflective material in order to enhance the effect of the LCD. Many LCD products have artwork printed on the LCD reflector in order to improve the appearance of the product. LCD segments that are "on" block ambient light from reflecting off the reflective background. LCD segments that are "off" allow the ambient light (and therefore the artwork on the reflective surface) to pass through.

The electronics of this invention include a microcontroller or similar state machine to monitor location of the LCD and switch and/or sensor outputs to control the LCD and audio transducer. The position of the LCD with respect to the reflector artwork will allow the microcontroller to display information of the LCD that is related to the current artwork. Many simple LCD products use the LCD in conjunction with the reflector artwork to provide feedback to the user. With an LCD moving over the reflector artwork, the microcontroller has to know where the LCD is with respect to the reflector to complete this function. Product switches and sensors are used by the game player to control the game action. The audio transducer is used with the LCD and reflector to provide feedback to the game player.

The sensors are mechanical and/or electrical that will allow the micro-controller where the LCD is with respect to the LCD reflector. The sensor can be mechanical, such as a gear system with a switch that is activated each time the LCD slides; or electronics, similar to a computer mouse, where an infrared signal is broken by the physical movement of the LCD.

The LCD can move over the reflective surface in many different pathways. The simplest method is a linear pathway. The linear pathway may consist of one path, vertical or horizontal, or it may consist of multiple paths, such as the path around the perimeter of the rectangular, triangular, or quadrilateral surface. The path may also be circular. Further, instead of a single dimensional path, the LCD may move over a two dimensional surface.

There will only be one LCD and it will be smaller than the colored background surface because it will be moved over that surface. The LCD will always be constant physically but the LCD is active: meaning artwork below it will be highlighted or turned on and off by the A computer so the images shown through the LCD will constantly change. There may be images that will only appear when the LCD is moved to certain parts of the play surface. The possibilities in terms of game playing theme and enhancements to current LCD games are increased by this novel improvement to LCD electronic game playing devices.

Figure 2:
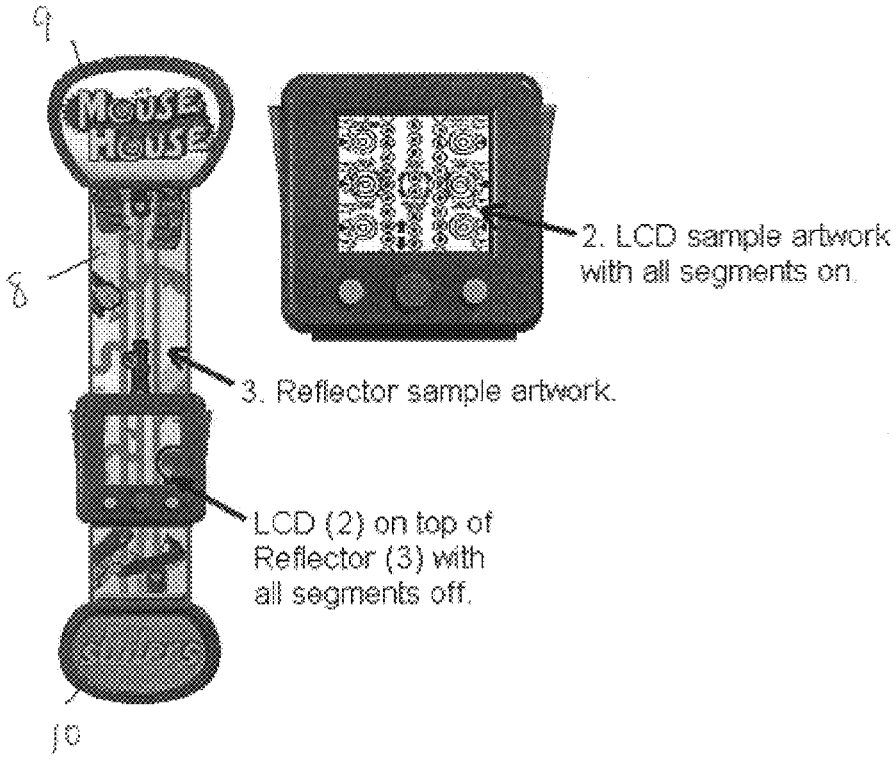
FIG. 2 shows a game including sample artwork according to an embodiment.

Referning now to FIG. 2, shown is the reflector surface with sample artwork (3) and the LCD housing (2) including sample artwork. The LCD housing (2) is shown installed above the reflector surface (3). The band (8) is shown below the reflector surface (3) as well as the upper block (9) and the lower block (10).

While the present invention has been described in detail, it will be readily appreciated to those skilled in the art that modifications and variations in addition to those mentioned above may be made without departing from the scope and spirit of the invention. Such modifications are to be considered as included in the following claims.

We claim:

1. A game playing housing comprising:

a rectangular band being uniform in width and having two ends; an upper end and a lower end, said upper end having an upper block and said lower end having a lower block which upper and lower blocks consist of a shaped protrusion from said band;

said game playing housing having a liquid crystal display or LCD housing movably engaged on said band so as to follow the LCD housing to move along the linear path of said band in an upward or downward direction;

said LCD housing comprising a computer consisting of a micro-controller and switch or sensor inputs and an audio transducer;

said sensors being mechanical and/or electrical to allow said micro-controller to identify the location of said LCD housing;

said band having two surfaces, a front surface and a rear surface, said front surface of said band having a cover permanently attached to said band composed of a reflective material and artwork;

said LCD housing having a liquid crystal display which is semi-transparent to allow the player to view the artwork below the LCD on the band;

said LCD housing having a front side and a rear side, said front side consisting of a liquid crystal display which is semi-transparent, and on/off controls and action controls for game playing use;

said rear side having one or more battery doors;

said LCD housing having within it a battery and said computer comprising said micro-controller and sensors.

2. The device as claimed in claim 1 wherein said band and said reflective surface engaged upon said band is a shape other than linear, including but not limited to circular, two dimensional, intersecting linear paths, perimeter of a square or triangle or any other configuration whereby said LCD housing may be slid over said band.

3. The device as claimed in claim 1 wherein said sensors are a mechanical gear system.

4. The device as claimed in claim 1 whereby said sensor is electronic.

* * * * *